US009578957B2

(12) United States Patent
Patel et al.

(10) Patent No.: US 9,578,957 B2
(45) Date of Patent: Feb. 28, 2017

(54) TOOTHBRUSH INCLUDING A DEVICE FOR INDICATING BRUSHING FORCE

(75) Inventors: Madhusudan Patel, Somerset, NJ (US); Thomas E. Mintel, Rahway, NJ (US); Sharon Kennedy, Randallstown, MD (US); John J. Gatzemeyer, Hillsborough, NJ (US); Eduardo J. Jimenez, Manalapan, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 649 days.

(21) Appl. No.: 14/002,770

(22) PCT Filed: Mar. 1, 2011

(86) PCT No.: PCT/US2011/026643
§ 371 (c)(1),
(2), (4) Date: Sep. 3, 2013

(87) PCT Pub. No.: WO2012/118487
PCT Pub. Date: Sep. 7, 2012

(65) Prior Publication Data

US 2013/0340188 A1 Dec. 26, 2013

(51) Int. Cl.

| | |
|---|---|
| ***A46B 9/04*** | (2006.01) |
| ***A46B 15/00*** | (2006.01) |
| ***A46B 9/06*** | (2006.01) |
| *A46B 3/20* | (2006.01) |
| *A46B 5/00* | (2006.01) |

(52) U.S. Cl.
CPC ..... *A46B 15/0044* (2013.01); *A46B 9/04* (2013.01); *A46B 9/06* (2013.01); *A46B 15/0012* (2013.01); *A46B 15/0038* (2013.01); *A46B 3/20* (2013.01); *A46B 5/0029* (2013.01); *A46B 5/0062* (2013.01); *A46B 2200/1066* (2013.01)

(58) Field of Classification Search
CPC .... A46B 9/04; A46B 15/0044; A46B 15/0012
See application file for complete search history.

(56) References Cited

U.S. PATENT DOCUMENTS

| | | | |
|---|---|---|---|
| 5,282,291 | A | 2/1994 | Spieler et al. |
| 5,320,784 | A | 6/1994 | Miyashita |
| 5,502,861 | A | 4/1996 | Spieler et al. |
| 5,732,721 | A | 3/1998 | Pelok |
| 6,330,730 | B1 | 12/2001 | Davies |
| 6,389,636 | B1 | 5/2002 | Savill |
| 8,424,144 | B2 | 4/2013 | Nanda |
| 2005/0066461 | A1 | 3/2005 | Chang |
| 2007/0259598 | A1 | 11/2007 | Ribi |
| 2008/0074643 | A1 | 3/2008 | Chen et al. |

(Continued)

FOREIGN PATENT DOCUMENTS

| | | |
|---|---|---|
| DE | 3724476 | 1/1989 |
| DE | 10 2009 03536 | 2/2011 |

OTHER PUBLICATIONS

Caruso et al., Mechanically-Induced Chemical Changes in Polymeric Materials, Chem. Rev. 109 2009 5755-5798. (2009).

(Continued)

*Primary Examiner* — Randall Chin

(57) ABSTRACT

A toothbrush that includes a piezochromic polymer or a proximity dye based polymer effective to emit an optical signal indicative of brushing force.

15 Claims, 3 Drawing Sheets

(56) References Cited

U.S. PATENT DOCUMENTS

| | | | | |
|---|---|---|---|---|
| 2010/0029004 | A1 | 2/2010 | Ribi | |
| 2010/0104826 | A1 | 4/2010 | Bastiaansen et al. | |
| 2011/0091391 | A1* | 4/2011 | Ribi ..... | A46B 15/0002 424/48 |

OTHER PUBLICATIONS

Davis et al., Force-induced activation of covalent bonds in Mechanoresponsive polymeric materials, Nature 459 2009 68-72. (2009).

International Search Report and the Written Opinion of the International Searching Authority issued in International Application PCT/US2011/026643 mailed Dec. 12, 2011.

Potisek et al., "Mechanophore-Linked Addition Polymers." J. Am. Chem. Soc., 2007, 129 (45), pp. 13808-13809.

Weder, Mechanochemistry: Polymers React to Stress, Nature 459 2009 45-46. (2009).

Pucci et al., Polymer composites with smart optical properties, Soft Matter, The Royal Society of Chemistry 7 2011 3689-3700. (2011).

* cited by examiner

TOOTHBRUSH INCLUDING A DEVICE FOR INDICATING BRUSHING FORCE

CROSS-REFERENCE TO RELATED PATENT APPLICATIONS

The present application is a U.S. national stage application under 35 U.S.C. 371 of PCT Application No. PCT/US2011/026643, filed Mar. 1, 2011, the entirety of which is incorporated herein by reference.

FIELD OF THE INVENTION

The present invention relates to a toothbrush, and in particular to a toothbrush which incorporates a device to indicate to the user that a suitable force is being applied during brushing.

BACKGROUND

It is widely appreciated that people cause serious damage to their teeth and gums by brushing too hard, and there have been a number of designs of toothbrush aimed at overcoming this problem. Several studies have arrived at the conclusion that excessive force during brushing leads to recession on premolars, and also gingival recession, which exposes the underlying cementum, often leading to hypersensitivity, loss of aesthetics, and may be a factor in root caries and root surface abrasion, leading to root fillings.

One solution is a brush, which simply will not transmit excessive force, for example a design disclosed in DE 3724476 where the neck of the toothbrush buckles if the user attempts to brush too hard. This, however, may result in a relatively flimsy product, which may be frustrating to use, as brushing may continually be interrupted.

Another known solution is disclosed in U.S. Pat. No. 5,502,861, which provides a toothbrush with an indicator which signals to the user if excessive force is being applied. This has the advantage that the user is provided with a clear signal that brushing is too hard, and which can be used to learn to brush correctly. It is disclosed in U.S. Pat. No. 5,282,291 that it is thought preferable to make the indicator mechanism an integral part of the brush, rather than an attachment to it; the latter arrangement generally results in a brush which is awkwardly shaped and unnatural to use.

Designs incorporating integral indicators, which are activated by electrical circuits, are known. In the design disclosed in U.S. Pat. No. 5,282,291, components of the circuit are brought into contact as the brush flexes, completing the circuit and triggering the indicator. Often, the user must fit a battery to power the indicator, which due to the limited size of the brush must be small and is, therefore, tricky to fit. In designs where a battery is required, access to the circuitry must be available, for example through a removable cover. This arrangement is inevitably less hygienic: the cover is unlikely to fit exactly flush with the handle surface and debris may collect in any gap between the cover and handle and also in the cavity itself. The device disclosed in DE 3724476 avoids the problem of powering the indicator circuit by relying instead on a piezoelectric component to act as a mechanical-electrical converter producing an electrical signal in response to the applied force. Obviously, these designs require a number of miniature components fitted into a small cavity in the brush handle, which is likely to render them difficult and therefore expensive to manufacture. Also, it is not ideal to locate a battery in a persistently damp environment, especially if it has to be replaced from time to time.

These disadvantages can be overcome by the use of an indicator, which does not require a separate power source or complex circuitry and can be incorporated easily into the body of the brush. U.S. Pat. No. 6,389,636, for example, discloses a toothbrush comprising a piezochromic material, which signals suitable brushing force without the provision of a power supply or electrical circuitry. See also U.S. Pat. No. 6,330,730.

Despite the foregoing developments, there is room for further improvements.

BRIEF SUMMARY OF THE INVENTION

According to a first aspect of the invention there is provided a toothbrush comprising a piezochromic polymer effective to emit an optical signal indicative of brushing force.

In certain embodiments, the toothbrush further comprises:

(a) a handle;

(b) a head;

(c) bristles positioned on the head; and (d) a neck joining the handle to the head, wherein at least one of the handle, the head, the bristles and the neck comprises the piezochromic polymer.

In certain embodiments, the piezochromic polymer is contained in a cavity within the toothbrush, and at least a portion of the toothbrush overlying the cavity is transparent or translucent such that the piezochromic polymer is visible. In such embodiments, it is preferred that the portion of the toothbrush overlying the cavity is a window located on a back side of the toothbrush, such that the piezochromic polymer is visible when teeth of a user are being brushed in front of a mirror.

In certain embodiments, the piezochromic polymer is an electrocylic ring-opening mechanophore. In certain embodiments, the electrocylic ring-opening mechanophore comprises spiropyran. In some embodiments, the spiropyran molecue can be incorporated in a poly(methyl acrylate) polymer or a poly(methyl methacrylate) polymer.

In certain embodiments, the optical signal is at least one color change indicative of at least one of excessive brushing force, acceptable brushing force and inadequate brushing force.

In certain embodiments, the toothbrush is free of a power supply and electrical circuitry.

In certain embodiments, the toothbrush further comprises an elongated bladder adapted to transmit force from the head to the piezochromic polymer, wherein the piezochromic polymer is located in or on the neck.

In certain embodiments, the toothbrush further comprises a lever inside the head and neck, wherein the lever is adapted to transmit force from the head to the piezochromic polymer, wherein the piezochromic polymer is located in or on the neck.

In certain embodiments, at least some of the bristles comprise the piezochromic polymer.

In certain embodiments, at least a bristle-contacting surface of the head comprises the piezochromic polymer, and the bristles are sufficiently transparent or translucent such that a color of the bristle-contacting surface of the head is visible.

According to a second aspect of the invention there is provided a toothbrush comprising a proximity dye based polymer effective to emit an optical signal indicative of brushing force.

In certain embodiments of the second aspect of the invention, the toothbrush further comprises:

(a) a handle;

(b) a head;

(c) bristles positioned on the head; and (d) a neck joining the handle to the head, wherein at least one of the handle, the head, the bristles and the neck comprises the proximity dye based polymer.

In certain embodiments of the second aspect of the invention, the proximity dye based polymer is contained in a cavity within the toothbrush, and at least a portion of the toothbrush overlying the cavity is transparent or translucent such that the proximity dye based polymer is visible. In some of these embodiments, the portion of the toothbrush overlying the cavity is a window located on a back side of the toothbrush, such that the proximity dye based polymer is visible when teeth of a user are being brushed in front of a mirror.

In certain embodiments of the second aspect of the invention, the optical signal is at least one color change indicative of at least one of excessive brushing force, acceptable brushing force and inadequate brushing force.

In certain embodiments of the second aspect of the invention, the toothbrush is free of a power supply and electrical circuitry.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWING

The present invention will become more fully understood from the detailed description and the accompanying drawings, wherein.

DETAILED DESCRIPTION OF THE INVENTION

Figure 1:
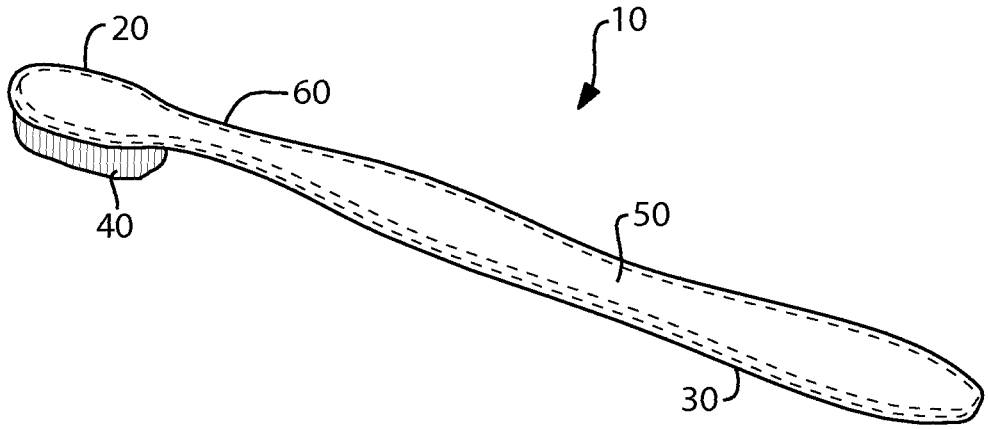
FIG. 1 is a perspective view of a first embodiment of the invention showing a brush having an internal cavity which is completely filled with piezochromic material.

The following description of the preferred embodiment(s) is merely exemplary in nature and is in no way intended to limit the invention, its application, or uses.

The invention comprises a toothbrush incorporating an indicator comprising a pressure (or force) indicating material which provides a signal without the provision of a power supply, such as a battery, and without the provision of electrical circuitry, characterized in that the indicator is capable of providing the signal when a predetermined brushing pressure (or force) is being or has been applied.

Thus, the user can be provided with a visible signal that a suitable brushing force is being or has been used, and/or a visible signal that an excessive brushing force is being or has been used. A suitable brushing force is preferably less than 3.5 N or less than 3 N or 0.5-2.9 N or 1-2.75 N or 1.5-2.5 N. Thus, in certain embodiments, the brush can be designed to generate a visible signal when brushing force is at least 0.5 N, and/or generate a visible warning signal when brushing force is 3 N or greater.

In certain embodiments, the signal is provided when a suitable brushing force is being applied and is absent when brushing force is too high.

Preferably, the pressure signal is a visible signal, which indicates to the user when a suitable brushing pressure and/or an unsuitable brushing pressure is being applied, but then may relax to its original state, e.g., its original color and/or intensity, after a period of time. This may or may not be after the user has finished a normal brushing regime. As such, the relaxation time of the material providing the optical response may typically be in the region of 1 second to 24 hours, though it is preferably long enough for the user to register it, and is preferably less than 24 hours. More preferably, the relaxation time for the pressure indicating material is from 1 second to 10 minutes or 1-10 seconds or 2-5 seconds.

The pressure indicating material according to the invention is a material adapted to show an optical response upon the application of pressure. Pressure indicating materials as defined herein include piezochromic materials, which as defined herein, refer to materials that show a color change in response to pressure (or force) being applied thereto.

In certain embodiments, a pressure indicating material is a material that shows an optical response to a stimulus other than pressure, wherein the stimulus is provided to the material by another element of the toothbrush as a function of brushing force.

Suitable piezochromic materials include but are not limited to piezochromic polymers, such as for example, crystals of toluene sulphonate diacetylene polymers; or copolymers containing poly(diacetylenes) or poly(silylenes). Again, the pressure indicating material may be one susceptible to relative changes in refractive index upon the application of pressure, for example aromatic solvents containing poly(N-methyl acrylamide).

In certain embodiments, the pressure indicating material is piezochromic material of the electrocylic ring-opening mechanophore type. Potisek et al., "Mechanophore-Linked Addition Polymers." J. Am. Chem. Soc., 2007, 129 (45), pp 13808-13809 discloses suitable methods for preparing certain electrocylic ring-opening mechanophores of the present invention. Preferred mechanophores include spiropyran. Preferred polymers to which the mechanophore is linked include poly(methyl acrylate) and poly(methyl methacrylate).

In certain embodiments, the indicator is capable of providing a signal when brushing pressure is being or has been applied and is absent when brushing pressure is too high. Thus it is an essential feature of such embodiments that the pressure indicating material is so calibrated to be capable of providing such a signal. An example of such calibration for a brush comprising a piezochromic material may be the presence of only a certain amount of the active shear sensitive material or the inclusion of an additional material, such as a polymer, which may act as a signal modifier, e.g., by changing the viscosity of the piezochromic material, which will prevent a signal being provided if the brushing pressure is too high.

It is also envisaged that the signal provided on application of brushing pressure may be graduated to reflect changes in brushing pressure within the suitable range and above the suitable range. For example, the signal may be green when brushing pressure is optimal; amber when pressure is sub-optimal but acceptable and red when pressure is approaching an unacceptable level. The signal would, of course, disappear when the correct pressure is no longer being applied. In a similar way, the intensity of the optical signal may vary with the intensity of the brushing pressure.

In an alternative aspect of the invention, the pressure indicating material is activated not by the process of brushing but by the user's grip. A strong grip may be suggestive of an aggressive brushing style which may damage the gums. Thus the indicating material may be incorporated so as to provide a signal when the user's grip is within a range which corresponds to a correct brushing pressure.

Indicator materials preferred for use in the invention display an optical response (a color change) within the range of pressure generated by brushing, which is not affected by the range of temperature to which a brush is normally subjected. A further property desired of a preferred indicator material is that this material can relax to its original state reasonably quickly. An indicator substance which requires a period of days to recover would not be suitable for the present application. It has, however, been found useful to use a material for providing the optical response which demonstrates a degree of hysteresis.

It is envisaged that the relaxation period of the indicator material may be such that it can be seen when the correct brushing pressure is being or has been exceeded during brushing, i.e., the signal disappears as soon as the correct pressure is no longer being applied.

The relaxation period may be so short that changes in brushing technique are quickly represented by the indicator material and several changes in brushing technique may be made.

In the known designs, a separate mechanism is used to trigger the indicator, for example a predetermined flexure of the brush or movement of the bristles causes two components to move relative to each other and to close an electrical circuit. In a preferred embodiment of the invention, the need for such a mechanism is avoided, as the force exerted on the brush is communicated directly to the indicator.

Less costly embodiments use a small amount of the pressure indicating material located in a pad, plate or bubble located in/on the brush head, in/on the neck of the brush, in/on the handle of the brush, and/or in/on the bristles. By way of example, the optical indicator (e.g., piezochromic) material can be heat-sealed into a vinyl envelope, or it can be otherwise encapsulated. Two plates of the pressure indicating material may be used, which plates are squashed together by an applied force. In one example, plates of the material are interleaved with the brush bristles. Pressure applied to the bristles causes bending of the bristles as well as the plates. In an alternative embodiment, the material is formed into a resilient membrane located at the base of the bristles, with the brush head preferably being transparent to allow the pressure indicating material to be visually inspected.

In another embodiment, a mechanical arrangement is provided to transmit the force to the indicator. For example, the brush may have two handle sections linked by a pivot, a portion of one of these sections extending beyond the pivot into a cavity provided in the other section. Excessive pressure causes the two sections to rotate relative to each other, in opposite directions about the pivot, such that one face of the extended portion will be brought into contact with the inner surface of the cavity in which it is located. That interior surface is provided with a pad of the pressure indicating material. Designs such as this, which employ moving elements to transmit the applied force to the indicator, have the advantage that the force may be amplified or reduced to fall within the response range of the pressure indicating material.

With regard to the other parts of the brush, the brush body may be made of materials and with methods used in the art, for example using injection molding techniques and materials such as polypropylene and polymethyl methacrylate. The bristles may be made of materials which are used in the art, including nylon and polybutylterephthalate.

Referring to the drawings, FIG. 1 shows a toothbrush 10 having a head 20 integrally formed with a handle 30 via a neck 60. The head 20 is provided with bristles 40 made of nylon. The head 20 and handle 30 are made of a resilient transparent material such as polymethyl methacrylate and define a cavity 50 extending substantially along the entire length of the brush 10. The cavity 50 is filled with a piezochromic material. A predetermined pressure (suitable for brushing teeth) applied to the bristles 40, or a predetermined flexure of the handle 30, will be transmitted to, and thereby cause an optical response (such as a change of color) of, the piezochromic material. The cavity 50 may, instead of extending substantially the entire length of the brush 10, be more localized, for example, it may be confined to a neck region 60 joining the handle 30 to the head 20.

Figure 2:
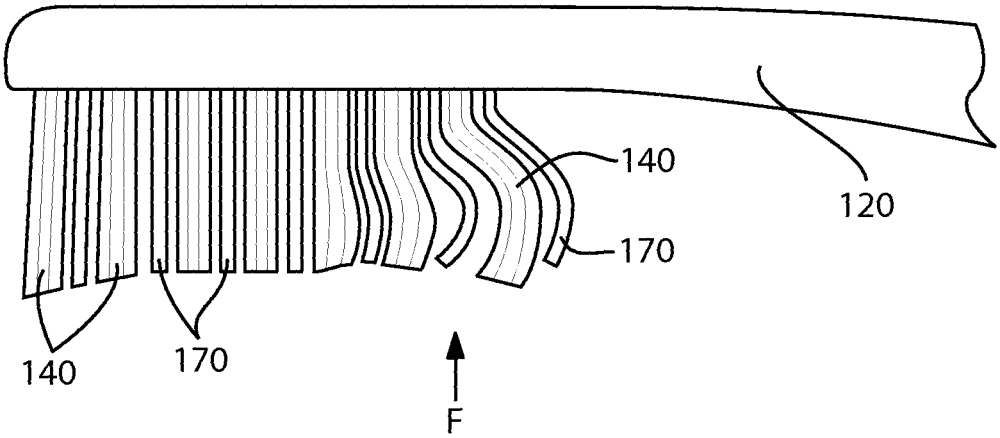
FIG. 2 is a side view of a brush head according to a second embodiment of the invention showing bristles interleaved with piezochromic plates.
Figure 3:
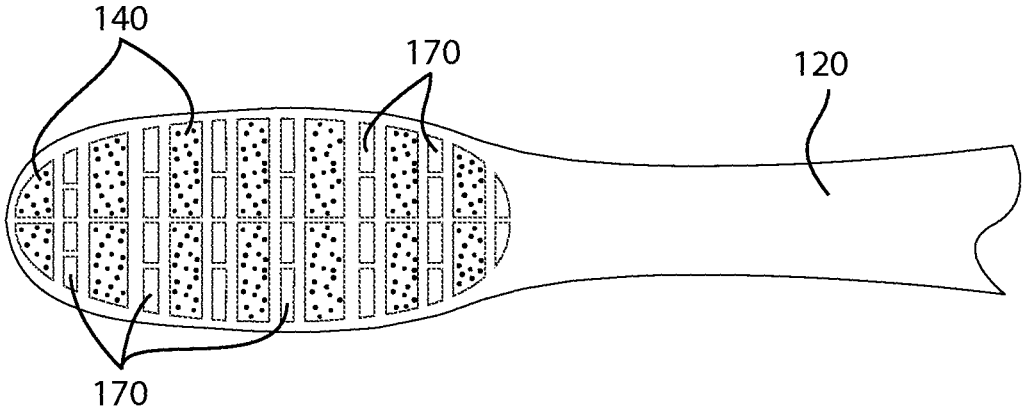
FIG. 3 is a plan view of the brush head of FIG. 2.

FIGS. 2 and 3 show respectively a side and plan view of the head 120 of a second embodiment of the invention to a larger scale. Bristles 140 are interleaved with plates 170 made of piezochromic material. Force applied to the brush head 120 in the direction of arrow F causes flexure of the bristles 140 and the plates 170 in the way shown, and this deformation is transmitted to the plates 170 which will cause an optical response such as a change in color in the piezochromic material as a function of brushing pressure.

Figure 4:
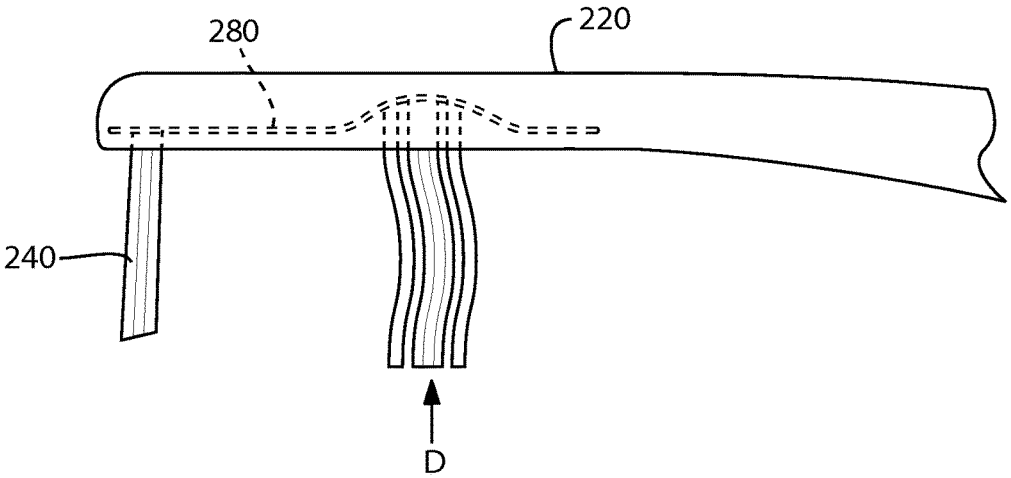
FIG. 4 is a side view of a brush head according to a third embodiment of the invention showing a membrane at the base of a bristle array.

FIG. 4 shows a side view of a third embodiment of the invention, and shows a brush head 220 provided with bristles 240. The base of each bristle 240 is attached to a flexible membrane 280, which contains the piezochromic material. Force applied to the bristles 240 in the direction of arrow D is transmitted to the membrane 280, and causes it to deform. Deformation of the membrane 280 stresses the piezochromic material contained within it, causing an optical response in the material such as a change of color on the application of suitable force.

Figure 5:
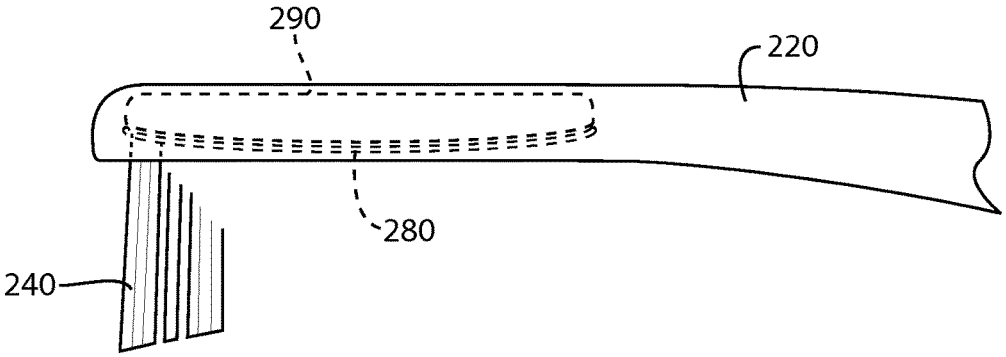
FIG. 5 is a side view of a modified version of the brush head of FIG. 4 showing the membrane replaced by a bubble of piezochromic material.

FIG. 5 shows a modified version of the brush head of FIG. 4, in which piezochromic material is contained in a sac 290. Force applied to the bristles 240 is transmitted to the sac 290 via flexible membrane 280 causing it to deform, thereby causing an optical response in the piezochromic material. In this modified brush head, the membrane 280 does not contain piezochromic material. Indeed, in a further modification, the membrane is not required, in which case force applied to the bristles 240 is transmitted directly to the sac 290.

Figure 6:
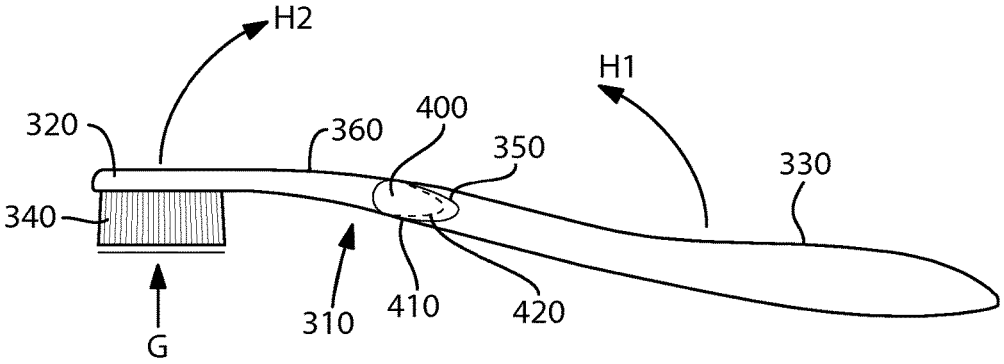
FIG. 6 is a side view of a fourth embodiment of the invention showing two handle sections linked by a pivot.

FIG. 6 shows a side view of a fourth embodiment of the invention, in which a handle 330 and a neck 360 of the brush 310 are pivotally connected at 400. A portion 410 (indicated in dotted lines) of the neck 360 extends beyond the pivot 400 into a cavity 350 formed in the handle 330. The neck 360 is integral with the head 320 of the brush 310.

In this embodiment, at least the handle 330 is formed of a transparent plastics material such as polymethyl methacrylate. Force applied to the bristles 340 of the brush 310 in the direction of arrow G, whilst the handle 330 is being held firmly, causes the handle and the head 320 to rotate relative to each other about the pivot 400 in the directions of the arrows H1 and H2.

Rotation is impeded as the neck portion 410 comes into contact with a pad 420 containing a piezochromic material. Continued mechanical force applied to the head 320 of the brush 310 is transmitted to the pad 420 causing an optical response in the piezochromic material.

Figure 7:
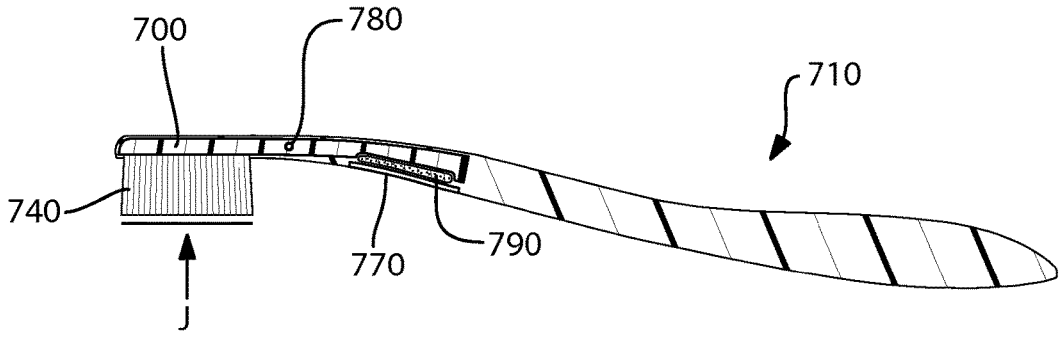
FIG. 7 is a cross-sectional view of a fifth embodiment of the invention showing a lever mechanism for transmitting brushing force to piezochromic material in the handle.

FIG. 7 shows a cross-sectional view of a fifth embodiment of the invention, in which brush 710 contains lever 700, which pivots about fulcrum 780 when force J is applied against bristles 740, such that force J is transmitted from bristles 740 to piezochromic material 790, which is located in the neck of the brush. The optical response of piezochromic material 790 is visible through window 770. Although FIG. 7 shows the window in the front side (i.e., bristle side) of brush 710, it is also within the scope of the invention for piezochromic material 790 and window 770 to be placed on the back side of the brush with lever mechanism rearranged, e.g., to a second class type lever wherein fulcrum 780 is located further down the neck or handle than piezoelectric material 790.

Figure 8:
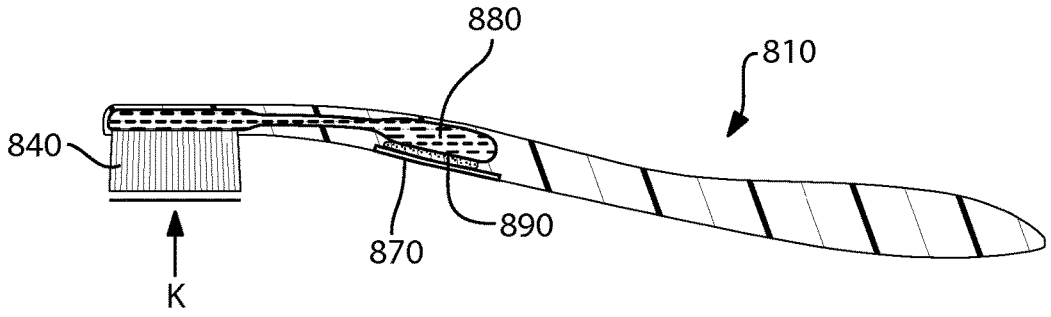
FIG. 8 is a cross-sectional view of a sixth embodiment of the invention showing a hydraulic mechanism for transmitting brushing force to piezochromic material in the handle.

FIG. 8 shows a cross-sectional view of a sixth embodiment of the invention, in which brush 810 contains bladder 880, which hydraulically transmits force K, which is applied against bristles 840, to piezochromic material 890 located in the neck of the brush. The optical response of piezochromic material 890 is visible through window 870. Although FIG. 8 shows the window in the front side of brush 810, it is also within the scope of the invention for piezochromic material 890 and window 870 to be placed on the back side of the brush.

In alternative embodiments, polarized materials are used as pressure indicating material, with pieces of polarized material being configured such that their planes of polarization are at 90° to each other. One of the pieces of material is fixed, and the other is able to move on the application of excessive pressure (for example by being attached to a mechanical type embodiment as described in conjunction with FIGS. 6 and 7 above) such that a different orientation of polarization planes is achieved, and thereby a color change is observed. Otherwise, also envisaged is an embodiment of sheet form polarizers which are orientated parallel to each other, and which are separated by an arrangement such as a coiled spring and/or a helical arrangement, whereby the two polarizers are caused to rotate relative to each other when they are brought closer to or further apart from each other in response to changes in brushing pressure. As a result, the polarizers adopt a different configuration relative to each other, and a color change is observed.

In further alternative embodiments, the pressure indicating material is a polymer that signals brushing force by re-orientation of initial dye-dye interactions within neighboring polymer fibers. Such pressure-sensitive polymers can be created by taking advantage of the property of certain dye molecules that change color based on their proximity to other dye molecules. These "proximity dye based polymers" can be used, e.g., in embodiments analogous to those of FIG. 6, wherein the relative rotation of handle 330 and head 320 about pivot 400 will cause the dye molecules inside the polymer to approach each other, and in embodiments analogous to that of FIGS. 2-3, wherein brushing force causes proximity dye based polymers of the bristles to approach each other. The enhanced proximity causes the emission properties of the dye molecule to change either via charge transfer interaction or excimer formation. This appears as an optically different color. Repeated high pressure brushing may prevent reversibility and lock in color and could also be used as an indicator for the lifetime of a toothbrush.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

What is claimed is:

1. A toothbrush comprising:
a handle;
a head;
bristles positioned on the head;
a neck joining the handle to the head; and
a piezochromic polymer effective to emit an optical signal indicative of brushing force, wherein the piezochromic polymer comprises an electrocyclic ring-opening mechanophore; and
wherein at least a bristle-contacting surface of the head comprises the piezochromic polymer, and the bristles are sufficiently transparent or translucent such that a color of the bristle-contacting surface of the head is visible.

2. The toothbrush of claim 1, wherein the piezochromic polymer is contained in a cavity within the toothbrush, and at least a portion of the toothbrush overlying the cavity is transparent or translucent such that the piezochromic polymer is visible.

3. The toothbrush of claim 2, wherein the portion of the toothbrush overlying the cavity is a window located on a back side of the toothbrush, such that the piezochromic polymer is visible when teeth of a user are being brushed in front of a mirror.

4. The toothbrush of claim 1, wherein the piezochromic polymer comprises spiropyran.

5. The toothbrush of claim 4, wherein the piezochromic polymer comprises poly(methyl acrylate) or poly(methyl methacrylate).

6. The toothbrush of claim 1, wherein the optical signal is at least one color change indicative of at least one of excessive brushing force, acceptable brushing force and inadequate brushing force.

7. The toothbrush of claim 1, wherein the toothbrush is free of a power supply and electrical circuitry.

8. The toothbrush of claim 1, further comprising a lever inside the head and neck, wherein the lever is adapted to transmit force from the head to the piezochromic polymer, wherein the piezochromic polymer is located in or on the neck.

9. The toothbrush of claim 1, wherein at least some of the bristles comprise the piezochromic polymer.

10. A toothbrush comprising:
a handle;
a head;
bristles positioned on the head;
a neck joining the handle to the head; and
a proximity dye based polymer effective to emit an optical signal indicative of brushing force; and wherein at least a bristle-contacting surface of the head comprises the proximity dye based polymer, and the bristles are sufficiently transparent or translucent such that a color of the bristle-contacting surface of the head is visible.

11. The toothbrush of claim 10, wherein at least some of the bristles comprise the proximity dye based polymer.

12. The toothbrush of claim 10, wherein the proximity dye based polymer is contained in a cavity within the toothbrush, and at least a portion of the toothbrush overlying the cavity is transparent or translucent such that the proximity dye based polymer is visible.

13. The toothbrush of claim 12, wherein the portion of the toothbrush overlying the cavity is a window located on a back side of the toothbrush, such that the proximity dye based polymer is visible when teeth of a user are being brushed in front of a mirror.

14. The toothbrush of claim 10, wherein the optical signal is at least one color change indicative of at least one of excessive brushing force, acceptable brushing force and inadequate brushing force.

15. The toothbrush of claim 10, wherein the toothbrush is free of a power supply and electrical circuitry.

* * * * *